US005803594A

United States Patent [19]

Fredrickson et al.

[11] Patent Number: 5,803,594

[45] Date of Patent: Sep. 8, 1998

[54] METHOD AND OUTDOOR LIGHT ACCESSORY FOR ENHANCING THE APPEARANCE OF LANDSCAPE LIGHTING

[76] Inventors: Linda L. Fredrickson; Ann Hoch, both of Anlin Worldwide, 32213 Placer Belair, Temecula, Calif. 92592

[21] Appl. No.: 771,949

[22] Filed: Dec. 23, 1996

[51] Int. Cl.[6] ..... F21V 1/00

[52] U.S. Cl. ..... 362/351; 362/805; 362/806

[58] Field of Search ..... 362/153, 153.1, 362/805, 806, 368, 370, 457

[56] References Cited

U.S. PATENT DOCUMENTS

| | | | |
|---|---|---|---|
| 4,052,608 | 10/1977 | Papenmeier | 362/368 |
| 4,758,934 | 7/1988 | Von Kohorn | 362/145 |
| 4,992,914 | 2/1991 | Heiss et al. | 362/153.1 |
| 5,160,202 | 11/1992 | Legare | 362/153 |
| 5,178,454 | 1/1993 | Lai | 362/431 |
| 5,280,417 | 1/1994 | Hall et al. | 362/226 |
| 5,307,254 | 4/1994 | Russello et al. | 362/368 |
| 5,477,442 | 12/1995 | Self | 362/368 |
| 5,526,243 | 6/1996 | Masters | 362/122 |
| 5,649,760 | 7/1997 | Beadle | 362/270 |

OTHER PUBLICATIONS 1996 product brochure of Intermatic Incorporated of Spring Grove, Illinois, showing low voltage lamps mounted on artificial rocks for landscaping purposes on p. 11.

*Primary Examiner*—Ira S. Lazarus
*Assistant Examiner*—David B. Lee
*Attorney, Agent, or Firm*—Loyal McKinley Hanson

[57] ABSTRACT

A method for enhancing the appearance of landscape lighting, includes providing a shell having a size and shape adapted to cover an outdoor light fixture of predetermined size. The is composed at least partially of a translucent material and it has an exterior with a stone-like appearance. The method proceeds by covering the outdoor light fixture with the shell in order to conceal the outdoor light fixture with a decorative cover while still enabling light to pass outwardly through the shell. In line with the above method, an outdoor light accessory for enhancing the appearance of landscape lighting, includes a shell of translucent material having a size and shape and stone-like appearance as described above. One embodiment of the shell is composed of a translucent polystyrene material molded in a desired configuration to include three flanges through which plastic ground stakes can be driven to secure the shell in place.

6 Claims, 1 Drawing Sheet

METHOD AND OUTDOOR LIGHT ACCESSORY FOR ENHANCING THE APPEARANCE OF LANDSCAPE LIGHTING

BACKGROUND OF THE INVENTION

1. Technical Field

This invention relates generally to landscape lighting, and more particularly to a method and outdoor light accessory for enhancing the appearance of landscape lighting.

2. Description of Related Art

Landscapers often install a series of outdoor lights along a pathway for safety and aesthetics. The lights identify and illuminate the pathway while creating a distinctive lighting pattern. Similar lighting is often used along decorative flower beds and patio borders, to highlight ponds and garden features, and to otherwise light and decorate residential and commercial grounds as part of the overall landscaping.

So, the appearance and other features of outdoor light fixtures are important, and manufacturers provide many different styles and models for residential and commercial use. Landscapers and other users nevertheless continue to seek additional options to use in their craft.

SUMMARY OF THE INVENTION

This invention addresses the need outlined above by covering an outdoor light fixture with a stone-like shell of translucent material. The shell conceals the lighting fixture. It also provides a pleasing stone-like appearance during the day that appears to glow at night. The translucent material enables sufficient light to pass outwardly through the shell for illumination purposes.

Thus, an outdoor light accessory constructed according to the invention (i.e., a stone-like shell of translucent material) works with existing outdoor light fixtures, including the low voltage fixtures in common use. It provides an inexpensive, easy-to-install option for the landscaper, and it can be added to many existing installations.

Referred to as a "MoonStone" the shell (i.e., a simulated landscape rock shell) can be placed over free-standing, low-voltage lights so that it is illuminated from within to provide ambient, safety, and pathway lighting. It conceals unsightly lighting fixtures. The simulated granite or sandstone surface of the shell blends in with the landscape design by day. But when the lighting fixture is turned on at night, the shell seems to glow to provide safety and pathway lighting, drenching the environment in simulated moonlight.

To paraphrase some of the claim language that is subsequently presented, a method for enhancing the appearance of landscape lighting, includes the step of providing a shell having a size and shape adapted to cover an outdoor light fixture of predetermined size. The shell is composed at least partially of a translucent material, and the shell has an exterior with a stone-like appearance. The method proceeds by covering the outdoor light fixture with the shell in order to conceal the outdoor light fixture with a decorative cover while still enabling light to pass outwardly through the shell.

In line with the above, an outdoor light accessory constructed according to the invention for enhancing the appearance of landscape lighting includes a shell of translucent material having a stone-like appearance and size and shape as described above. One embodiment of the shell is composed of a translucent polystyrene material molded in a desired configuration to include three flanges through which plastic ground stakes can be driven to secure the shell in place. The following illustrative drawings and detailed description make the foregoing and other objects, features, and advantages of the invention more apparent.

DESCRIPTION OF THE PREFERRED EMBODIMENTS

The drawings show an outdoor light accessory 10. It includes a shell 11 having a size and shape adapted to cover a landscape light fixture 12 of predetermined size. In other words, outdoor light accessories constructed according to the invention can have any of various sizes corresponding to the size of the outdoor light fixture they are designed to cover. The size of the shell depends on the size of the fixture it is designed to cover, and the illustrated shell 11 fits over the illustrated fixture 12.

Figure 1:
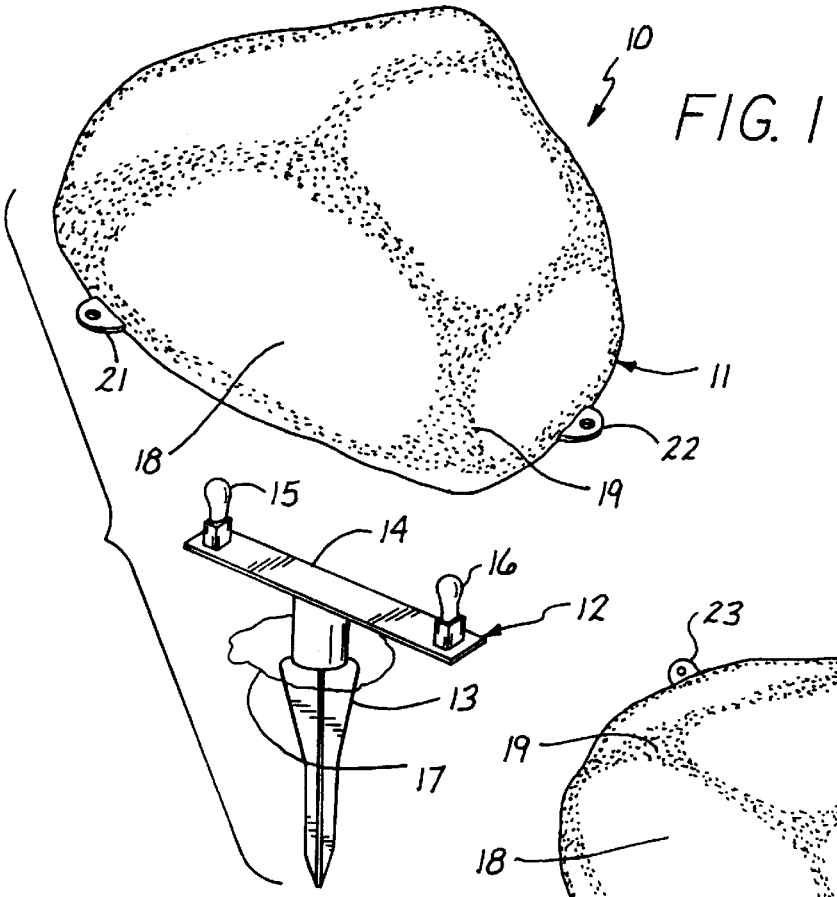
FIG. 1 of the drawings is an exploded three-dimensional view of an outdoor light accessory constructed according to the invention, with a bracket relating the translucent, stone-like shell to an outdoor light fixture of predetermined size that the shell is adapted to cover.
Figure 3:
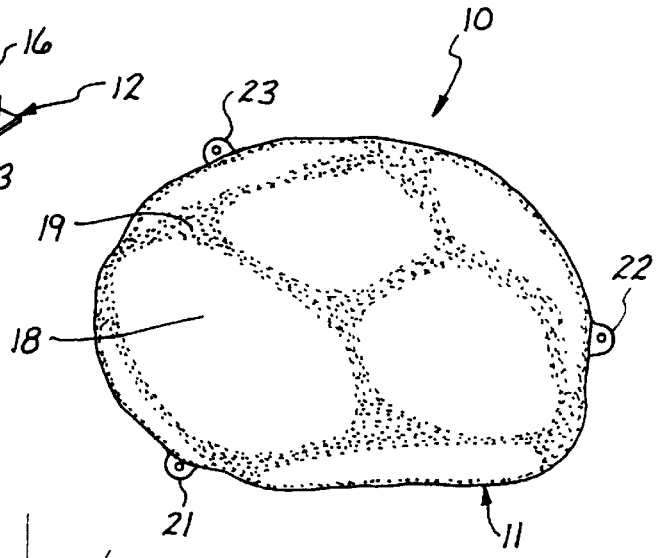
FIG. 3 is a top view of the cover.
Figure 2:
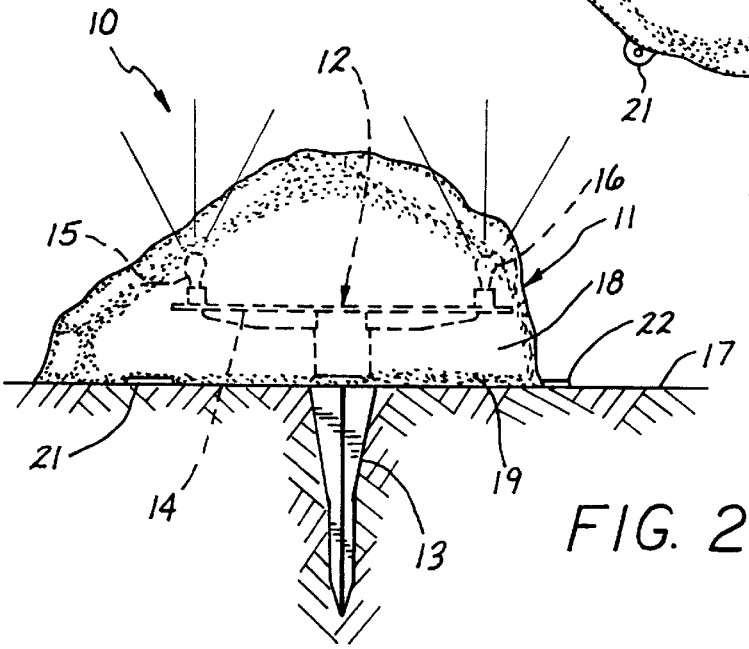
FIG. 2 is an elevation view of the shell in place over the light fixture.

The illustrated fixture 12 includes an Underwriter's Laboratory approved, 7-inch plastic ground stake 13, an 8-inch plastic cross arm 14, and two 4-watt, 12-volt low-voltage bulbs 15 and 16 to which suitable low-voltage electrical wiring is couple according to know techniques. That results in an overall 3-inch height of the fixture 12 and bulbs above the ground 17 when the fixture 12 is installed with the stake 13 driven in the ground 17 as shown in FIG. 2.

The shell 11 is dimensioned accordingly, to cover and conceal the fixture 12. Although the drawings are not exactly to scale for illustrative convenience, the maximum overall height of the shell 11 measured vertically above the ground 17 is about seven to ten inches. The maximum overall length measured parallel to the ground 17 and parallel to the plane of the drawing sheet is about fifteen to eighteen inches. The maximum overall width measured parallel to the ground 17 and perpendicular to the plane of the drawing sheet is about 10–15 inches. Of course, those dimensions are intended to show how the size of the shell relates to the size of the light fixture it covers, and they may vary without departing from the scope of the claims.

The shell 11 is composed at least partially of a translucent material that enables light emitted by the bulbs 15 and 16 to pass through the shell 11 and illuminated areas adjacent the shell 11. The lines in FIG. 2 extending upwardly from the bulbs 15 and 16 depict light rays passing through the shell 11. Any of various known materials and fabrication techniques may be employed. The illustrated shell 11, however, is composed of a translucent polystyrene material molded in a desired stone-simulating irregular shape with 1/16-inch thick walls and a granular texture on the exterior surface 18. A brown, grey, or other natural-appearing color combines with the irregular shape to simulate the exterior surface of a stone.

The texturing on the exterior surface 18 of the shell 11 is depicted in the drawings by stippling, some of the stippling being designated with a reference numeral 19. For illustrative convenience, the drawings only show the texturing on portions of the exterior surface 18, but it extends over the entire exterior surface 18. The mold in which the shell 11 is formed has textured walls that produce the texturing. After molding the shell 11, the exterior surface 18 is sprayed with a light coat of protective paint that provides further texturing, coloring, and speckling.

Thus, the exterior surface 18 of the shell 11 has what is referred to herein as a stone-like appearance and as a landscape-rock-like appearance. Based upon the preceding and subsequent descriptions, one of ordinary skill in the art can fabricate a suitable shell of translucent material for concealing the outdoor light fixture 12 with a decorative cover while still enabling light from the fixture 12 to pass outwardly to adjacent areas.

In addition to the foregoing, the illustrated shell 11 includes three ground stake tabs or flanges 21, 22, and 23. They are preferably molded with the rest of the shell 11, and they extend outwardly from the exterior surface 18 in order to rest on the ground 17 when the shell 1 1 is in place over the fixture 12. They function as means for enabling a user to secure the shell 11 to the ground 17. The user does so by driving a stake into the ground 17 through a hole in each of the flanges 21–23. The stakes are not shown in the drawings, but a commercially available plastic ground stake may be used.

Thus, the invention covers an outdoor light fixture with a stone-like shell of translucent material. The shell is placed over free-standing, low-voltage lights so that it is illuminated from within to provide ambient, safety, and pathway lighting. It conceals unsightly lighting fixtures. The simulated granite or sandstone surface of the shell blends in with the landscape design by day. When the lighting fixture is turned on at night, the shell seems to glow to provide safety and pathway lighting, drenching the environment in simulated moonlight.

Although an exemplary embodiment has been shown and described, one of ordinary skill in the art may make many changes, modifications, and substitutions without necessarily departing from the spirit and scope of the invention.

What is claimed is:

1. A method for enhancing the appearance of landscape lighting, comprising:

providing a shell having a size and shape adapted to cover an outdoor light fixture of predetermined size, the shell being composed at least partially of a translucent material, the shell having an exterior with a stone-like appearance, and the shell having means in the form of a plurality of flanges extending outwardly from the exterior of the shell for enabling a user to secure the shell to the ground with stakes driven into the ground through holes in the flanges after the shell is placed over the outdoor light fixture; and covering the outdoor light fixture with the shell in order to conceal the outdoor light fixture with a decorative cover while still enabling light to pass outwardly through the shell.

2. A method as recited in claim 1, further comprising the step of securing the shell to the ground.

3. An outdoor light accessory for enhancing the appearance of landscape lighting, comprising:

a shell having a size and shape adapted to cover an outdoor light fixture of predetermined size;

the shell being composed at least partially of a translucent material;

the shell having an exterior with a stone-like appearance; and the shell having a plurality of flanges extending outwardly from the exterior of the shell that function as means for enabling a user to secure the shell to the ground with stakes driven into the ground through holes in the flanges after the shell is placed over the outdoor light fixture.

4. An outdoor light accessory as recited in claim 3, wherein the shell includes means for enabling a user to secure the shell to the ground, including at least one flange adapted to receive a ground stake.

5. An outdoor light accessory as recited in claim 3, wherein the shell is composed of a translucent polystyrene material molded in a desired configuration.

6. An outdoor light accessory for enhancing the appearance of landscape lighting, comprising:

a shell having a size and shape adapted to be placed on the ground over an outdoor light fixture that extends three inches above the ground in order to cover the outdoor light fixture;

the shell being composed at least partially of a translucent material; and the shell having an exterior with a stone-like appearance; and the shell having means in the form of a plurality of flanges extending outwardly from the exterior of the shell for enabling a user to secure the shell to the ground with stakes driven into the ground through holes in the flanges after the shell is placed over the outdoor light fixture.

* * * * *